US008621815B2

(12) United States Patent
Daas et al.

(10) Patent No.: US 8,621,815 B2
(45) Date of Patent: Jan. 7, 2014

(54) LATTICE SUPPORT STRUCTURE

(75) Inventors: Kamal Daas, Bergschenhoek (NL); Doron Livnat, Rotterdam (NL)

(73) Assignee: Prodelta Investments B.V. (NL)

( * ) Notice: Subject to any disclaimer, the term of this patent is extended or adjusted under 35 U.S.C. 154(b) by 51 days.

(21) Appl. No.: 12/994,529

(22) PCT Filed: May 27, 2009

(86) PCT No.: PCT/EP2009/003781

§ 371 (c)(1),
(2), (4) Date: Apr. 20, 2011

(87) PCT Pub. No.: WO2009/152938

PCT Pub. Date: Dec. 23, 2009

(65) Prior Publication Data

US 2011/0185674 A1 Aug. 4, 2011

(30) Foreign Application Priority Data

May 27, 2008 (DE) ..... 20 2008 007 109 U

(51) Int. Cl.
*E04H 12/18* (2006.01)

(52) U.S. Cl.
USPC ..... 52/645; 52/646; 52/632; 52/652.1; 52/651.1

(58) Field of Classification Search
USPC ..... 52/632, 645, 652.1, 646, 651.01, 40, 52/653.2, 655.1, 633, 641, 638, 651.1; 182/152; 248/150, 434
See application file for complete search history.

(56) References Cited

U.S. PATENT DOCUMENTS 3,235,038 A * 2/1966 Nesslinger ..... 182/62.5
4,089,147 A 5/1978 Bain (Continued)

FOREIGN PATENT DOCUMENTS

CH 690 927 A5 2/2001
DE 259 651 A1 8/1988

(Continued)

OTHER PUBLICATIONS

International Search Report in connection with International Application No. PCT/EP2005/010437, dated Dec. 8, 2005; 5 pages.

(Continued)

*Primary Examiner* — Chi Q Nguyen
(74) *Attorney, Agent, or Firm* — Carter, DeLuca, Farrell & Schmidt, LLP

(57) ABSTRACT

The present invention relates to a lattice support structure having lattice bars in connection with one another, wherein the lattice support structure has lattice bars extending in the longitudinal direction of the lattice support structure as well as lattice bars directly or indirectly connecting them, wherein the connecting lattice bars are connected to the lattice bars extending in the longitudinal direction such that the spacing of the lattice bars extending in the longitudinal direction of the lattice support structure can be reduced on the folding in of the lattice support structure and can be enlarged on the unfolding of the lattice support structure, characterized in that one, several or all of the connecting lattice bars are not displaceably arranged on the lattice bars extending in the longitudinal direction, but are rather pivotably arranged at the lattice bars extending in the longitudinal direction or are pivotably arranged at further connecting lattice bars which are in turn pivotably arranged at the lattice bars extending in the longitudinal direction.

30 Claims, 7 Drawing Sheets

(56) References Cited

U.S. PATENT DOCUMENTS

Figure 1:
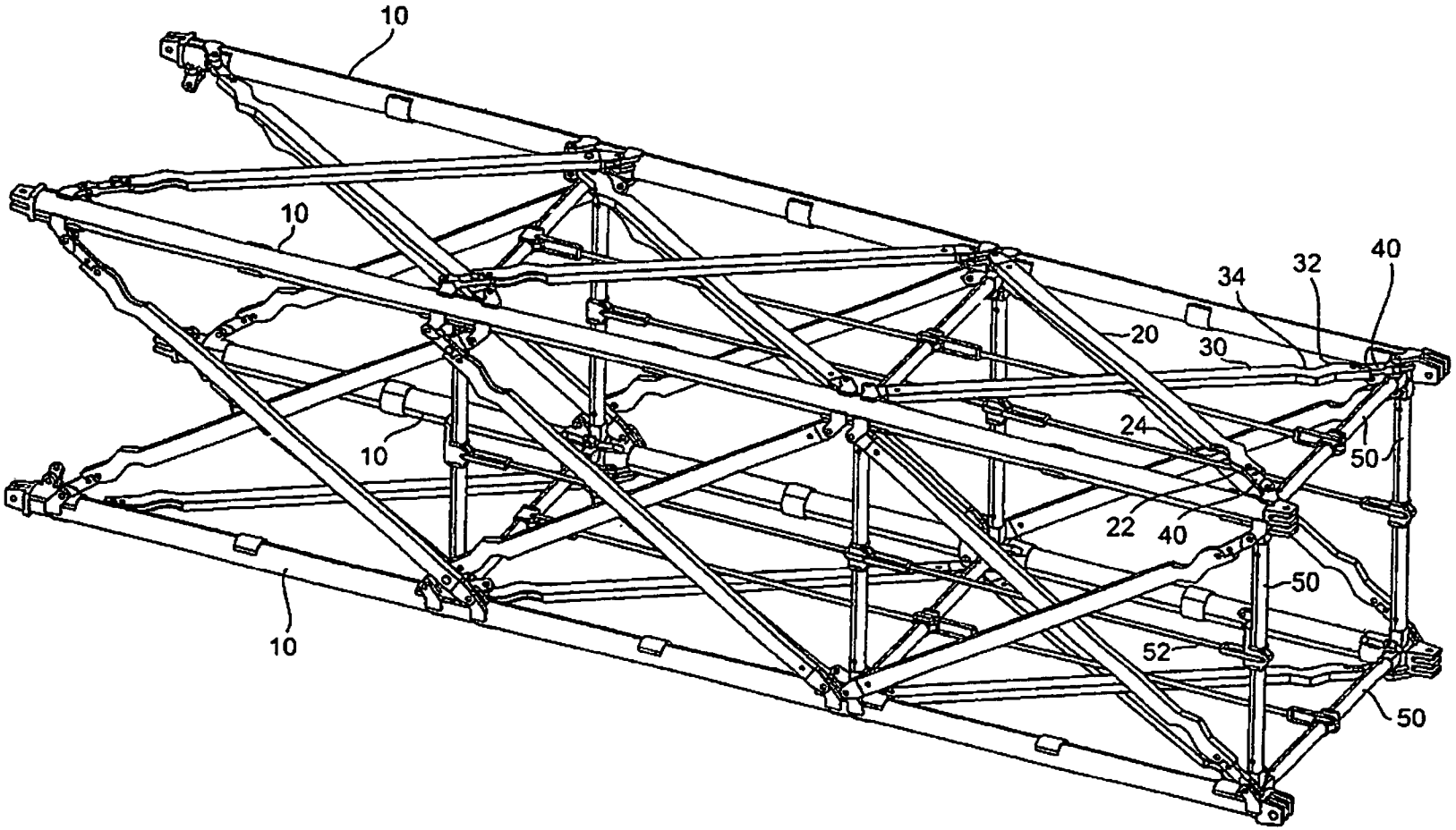

| | | | | |
|---|---|---|---|---|
| 4,259,790 | A | 4/1981 | Borisof | |
| 4,274,222 | A | 6/1981 | Zahn et al. | |
| 4,473,986 | A | 10/1984 | Zeigler et al. | |
| 4,539,786 | A | 9/1985 | Nelson et al. | |
| 4,722,162 | A | 2/1988 | Wilensky | |
| 4,761,929 | A | 8/1988 | Zeigler | |
| 4,765,114 | A | 8/1988 | Wesselski | |
| 4,791,761 | A | 12/1988 | Goudie et al. | |
| 4,841,708 | A * | 6/1989 | Johnston | 52/646 |
| 5,367,852 | A * | 11/1994 | Masuda et al. | 52/651.06 |
| 5,765,248 | A * | 6/1998 | Ono | 14/75 |
| 6,161,359 | A * | 12/2000 | Ono | 52/651.1 |
| 6,367,348 | B1 * | 4/2002 | Toelke et al. | 74/512 |
| 6,772,458 | B2 * | 8/2004 | Ellen et al. | 5/424 |
| 7,090,176 | B2 * | 8/2006 | Chavot et al. | 248/127 |
| 7,296,699 | B2 * | 11/2007 | Hung et al. | 211/189 |
| 7,766,024 | B2 * | 8/2010 | Rottmann | 135/156 |
| 7,779,598 | B2 | 8/2010 | Daas et al. | |
| 2005/0205726 | A1 | 9/2005 | Chavot et al. | |

FOREIGN PATENT DOCUMENTS

| | | | |
|---|---|---|---|
| DE | 202006008770 | U1 | 9/2007 |
| EP | 0 864 426 | A1 | 12/1998 |
| JP | 62-174451 | | 7/1987 |
| JP | 9-195530 | | 7/1997 |

OTHER PUBLICATIONS

International Search Report correpsonding to International Application No. PCT/EP2009/003781, completed on Dec. 13, 2012, (3 pages).

* cited by examiner

DETAIL B

LATTICE SUPPORT STRUCTURE

This application is the national stage of, and claims priority to, PCT Application No. PCT/EP2009/003781, filed May 27, 2009, which claims priority to German Utility Model Application No. 20 2008 007 109.7, filed on May 27, 2008, the entireties of which are both hereby incorporated by reference.

The present invention relates to a lattice support structure having mutually connected lattice bars, wherein the lattice support structure has lattice bars extending in the longitudinal direction of the lattice support structure as well as lattice bars connecting them directly or indirectly, wherein the connecting lattice bars are connected to the lattice bars extending in the longitudinal direction such that the spacing of the lattice bars extending in the longitudinal direction of the lattice support structure can be reduced on the folding in of the lattice support structure and can be enlarged on the unfolding of the lattice support structure.

Such lattice support structures are known in different embodiments.

They can be made, for example, as supporting elements, bearing elements or elements taking over other functions. Lattice support structures of the first named kind are furthermore known in which the inner space surrounded by the lattice support structure can be used for other functions such as stairs, elevators, etc.

In the lattice support structures known from the prior art, sleeves at which the connecting lattice bars are arranged run on the lattice bars extending in the longitudinal direction. If the lattice support structure is folded in or unfolded, there is accordingly a displacement of the sliding sleeves on the lattice bars extending in the longitudinal direction of the lattice support structure until the lattice support structure has reached its desired final position.

It is the object of the present invention to further develop a lattice support structure having the first named features such that its design is simplified with respect to a previously known lattice support structure.

This object is satisfied starting from a lattice support structure having lattice bars in connection with one another, wherein the lattice support structure has longitudinal lattice bars extending in the longitudinal direction of the lattice support structure as well as connecting lattice bars directly or indirectly connecting them, wherein the connecting lattice bars are connected to the lattice bars extending in the longitudinal direction such that the spacing of the lattice bars extending in the longitudinal direction of the lattice support structure can be reduced on the folding in of the lattice support structure and can be enlarged on the unfolding of the lattice support structure wherein at least one lattice bar, preferably all of the lattice bars to be connected, are not arranged displaceably on the lattice bars extending in the longitudinal direction, but are arranged pivotably thereon. Alternatively or additionally, provision can be made for lattice bars to be present which are arranged pivotably at a lattice bar which is in turn pivotably connected to one of the lattice bars extending in the longitudinal direction. One difference to previously known lattice support structure thus consists of the fact of being able to completely or partly dispense with the sliding sleeves known from the prior art on which the connecting lattice bars are arranged in previously known lattice support structures and which run on the lattice bars extending in the longitudinal direction. The design of the lattice support structure thereby becomes simpler. A further advantage results from the fact that no running surfaces for any sliding sleeves have to be kept free on the lattice bars extending in the longitudinal direction. Provision is preferably made for the lattice support structure not to have any sliding sleeves by means of which connecting lattice bars run on the lattice bars extending in the longitudinal direction.

In a further embodiment of the invention, a lattice support structure having lattice bars in connection with one another is provided, wherein the lattice support structure has lattice bars extending in the longitudinal direction of the lattice support structure as well as lattice bars directly or indirectly connecting them, wherein the connecting lattice bars are connected to the lattice bars extending in the longitudinal direction such that the spacing of the lattice bars extending in the longitudinal direction of the lattice support structure can be reduced on the folding in of the lattice support structure and can be enlarged on the unfolding of the lattice support structure, wherein one, several or all of the connecting lattice bars are pivotably arranged at a fixed position at the lattice bars extending in the longitudinal direction or at a fixed position of further connecting lattice bars which are in turn pivotably arranged at a fixed position at the lattice bars extending in the longitudinal direction.

Provision is made in a preferred embodiment of the invention for at least one of the connecting lattice bars to have a first length when the lattice support structure is unfolded and a second length when the lattice support structure is folded in, with the first length being larger than the second length. The length change of the lattice bars can take place, for example, in that they have a pivot lever in a first end region which is pivotably connected to a lattice bar extending in the longitudinal direction of the lattice support structure. In the inwardly pivoted state of the pivot lever, the length of the lattice bar is comparatively small; in the outwardly pivoted state of the pivot lever comparatively large.

It is conceivable to provide the connecting lattice bars with such a pivot lever only in one of their ends and to connect them to the lattice bars connecting in the longitudinal direction pivotably, but without using a pivot lever, in their other end. It is generally also conceivable to provide the pivot levers at both ends of the connecting lattice bars.

Provision is made in a further embodiment of the invention for the connecting lattice bars to have a mount, preferably a groove-shaped mount, in the end region in which the pivot lever is arranged, with the pivot lever being able to be received at least sectionally in said mount.

Provision is made in a further embodiment of the invention for the connecting lattice bars to be disposed in the outer surface or outer surfaces of the lattice support structure. The lattice bars extending in the longitudinal direction of the lattice support structure can form the outer edges of the lattice support structure.

It is, for example, conceivable to provide a lattice support structure which is square or rectangular in section and whose corner regions are formed by the lattice bars extending in the longitudinal direction and between which the connecting lattice bars extend. The invention is, however, generally not restricted hereto as other cross-sectional shapes of the lattice support structure are also conceivable.

The lattice support structure can have a structure of the connecting lattice bars which repeats in the longitudinal direction. It is, for example, conceivable that two connecting lattice parts respectively extend cross-ways and that this cross-type arrangement repeats in the longitudinal direction of the lattice support structure.

Connection braces are present in a further embodiment of the invention which extend perpendicular to the longitudinal direction of the lattice support structure in the unfolded state of the lattice support structure from one to another of the lattice bars extending in the longitudinal direction of the lattice support structure. These connection braces serve to increase the stability of the lattice support structure.

These connection braces can have at least one joint by means of which they can be adjusted between a folded-in state and an unfolded state. It is conceivable that the connection braces are spaced apart in the longitudinal direction of the lattice support structure and are connected to one another. It becomes possible in this manner, for example by actuating one of the connection braces, likewise to actuate further connection braces connected thereto. This can be necessary, for example, to effect the folding in of the lattice support structure or to lock the lattice support structure in the unfolded state.

Provision is made in a particularly advantageous embodiment of the invention for locking means to be provided by means of which the connection braces and/or the connecting lattice bars can be fixed in at least one position.

The locking means are preferably arranged such that the secure the lattice support structure in the unfolded state.

The invention furthermore relates to a lattice support structure with structures which can be spread apart, in particular to a lattice support structure, wherein the lattice support structure has pivotably arranged lattice bars, wherein the pivotable connection is made such that one of the parts pivotably connected to one another has a projection; and in that the other one of the pivotably connected parts has a groove which is bounded on three sides by walls and in which the projection of the other part is pivotably received. The base of the groove thus serves as a boundary so that a pivoting of the lattice bar is only possible for so far until the one of the named parts lies on the groove base. In this position, the lattice bar is thus blocked or a further pivoting is not possible. Such a pivotable connection can be provided where two segments of a lattice bar are pivotably connected to one another and/or where a lattice bar is pivotally connected to another part of the lattice support structure.

The lattice bar can have the projection at its one end region and the named groove at its other end region. It is possible in this manner to connect a plurality of lattice bars to one another or to provide lattice bars of different length. It is also generally conceivable to make both ends of the lattice bar with grooves or with the named projections.

It is particularly advantageous for a braking device or a fixing device to be provided which fixes the lattice bars in a specific pivot position. It can, for example, be a drum brake, a disk brake or a shoe brake. The brake can e.g. be actuated hydraulically or mechanically. The brake can have brake shoes which have two projections, said brake simultaneously coming into contact with the respective adjacent part, for example with the named projection, and thus developing an ideal braking effect, on actuation of the brake.

Figure 2:
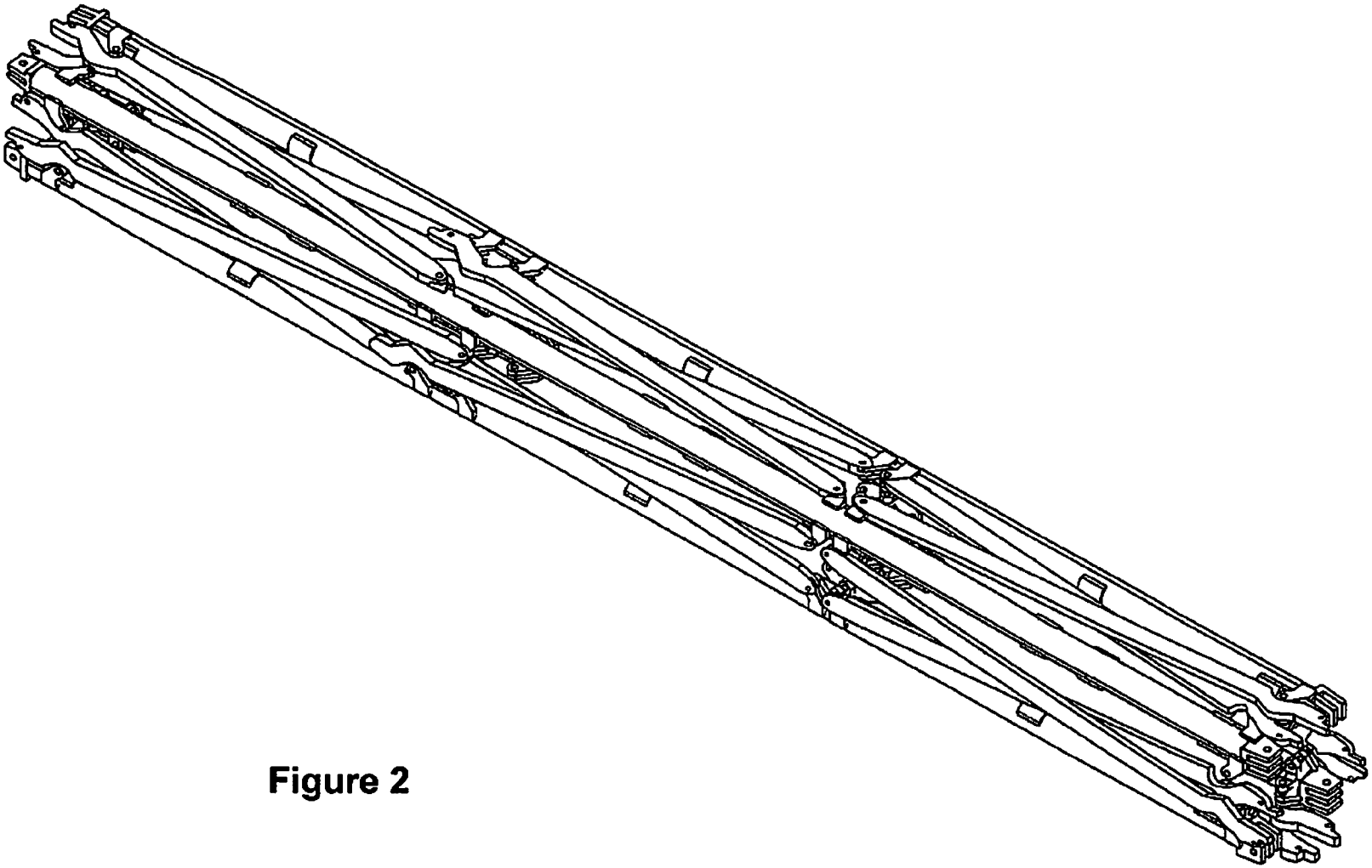
Figure 4:
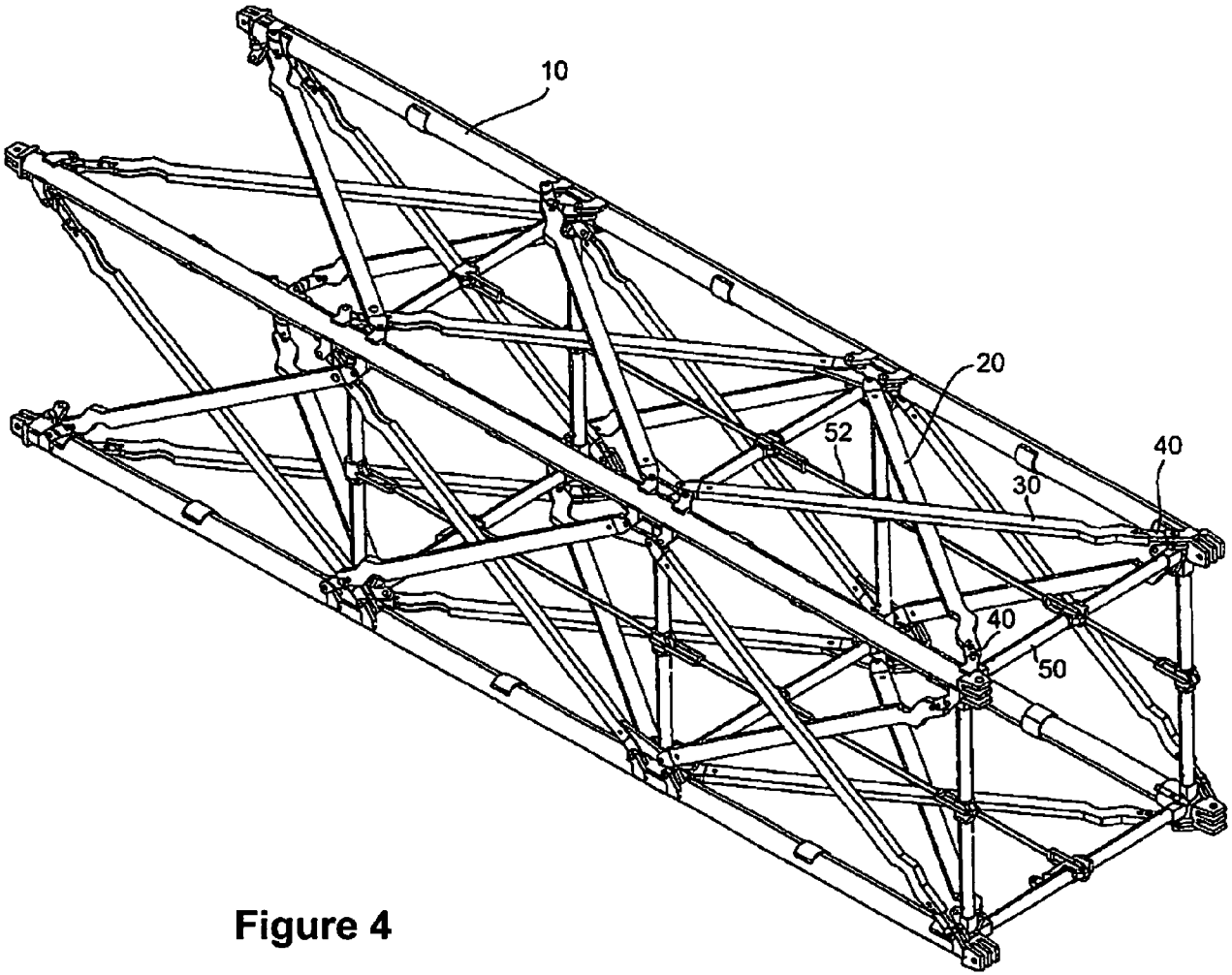

Further details and advantages of the invention will be explained in more detail with reference to an embodiment shown in the drawing. There are shown:

FIG. 1: a perspective representation of the lattice support structure in the unfolded state;

FIG. 2: a perspective representation of the lattice support structure in the folded-in state;

FIG. 3: a perspective representation of the lattice support structure in accordance with FIGS. 1 and 2 in different views and with a detailed view;

FIG. 4: a perspective representation of a lattice support structure in the unfolded state in a further embodiment;

FIG. 5: a perspective representation of the lattice support structure in accordance with FIG. 4 with different views and with detailed views.

With the reference numeral 10, FIG. 1 shows four lattice bars which extend in the longitudinal direction of the lattice support structure and which are arranged with respect to one another such that they form the four corners of a square in a cross-sectional view of the lattice support structure. A lattice support structure segment is shown. A plurality of such segments can be joined together by a suitable connection, e.g. by a bolt connection. As can furthermore be seen from FIG. 1, two respective lattice bars 10 are connected by a plurality of lattice bars 20, 30 to be connected, with in each case two lattice bars 20, 30 extending cross-ways, as can be seen from FIG. 1. This cross-wise arrangement is continued in the longitudinal direction of the lattice support structure as can likewise be seen from FIG. 1.

For reasons of clarity, all of the elements of the lattice support structure are not provided with reference numerals in the Figures. References numerals are only allocated to the extent required for explanation.

As can finally further be seen from FIG. 1, the connecting lattice bars 20, 30 form the four outer sides of the lattice support structure shown, whereas the lattice bars 10 form the corner regions.

If the structure shown is divided mentally into three segments which are sequential in the longitudinal direction, the result is that each segment substantially has the same arrangement of lattice bars 10 extending in the longitudinal direction and of connecting lattice bars 20, 30. Four lattice bars 10 extending in the longitudinal direction as well as eight connecting lattice bars 20, 30 are provided per segment, with two of the connecting lattice bars 20, 30 being disposed in an outer side of the segment and thus also of the lattice support structure.

What is important is that the lattice bars 20, 30 are not arranged in sliding sleeves on the lattice bars 10 extending in the longitudinal direction, but that they are rather directly or indirectly connected thereto via joint points. The joint points have a fixed location in the embodiment shown.

As can further be seen from FIG. 1, each of the connecting lattice bars 20, 30 has a pivot lever 40 in one of its end regions. This pivot lever 40 is pivotably connected to the remaining section of the lattice bar 20, 30, on the one hand, and is pivotably connected to the lattice bar 10 extending in the longitudinal direction of the lattice support structure, on the other hand. The connection between the pivot lever 40 and the other part of the lattice bar 20, 30 is such that the pivot lever 40 can be folded in, whereby the total length of the connecting lattice bar 20, 30 naturally reduces. In the embodiment shown in FIG. 1, the pivot levers 40 are folded outwardly, i.e. all the connecting lattice bars 20, 30 adopt their largest possible length.

For the reception of the pivot levers 40, the connecting bars 20, 30 have a groove-shaped mount 22, 32 in the adjacent section and the pivot levers 40 can be at least partly received therein in the folded-in state of the lattice support structure, as can be seen, for example, from FIG. 2. To achieve an arrangement which is as compact as possible, the connecting lattice bars 20, 30 have a further recess 24, 34 in which that section of the pivot lever 40 is disposed in the folded-in state of the lattice support structure which is pivotably connected to the lattice bar 10 extending in the longitudinal direction.

The lattice support structure furthermore has connection braces 50 which are disposed in a plane extending perpendicular to the longitudinal direction of the lattice support structure. The connection braces 50 each connect two lattice bars 10 extending in the longitudinal direction. As can be seen from FIG. 1, the connection braces 50 thus form the sides of a square, provided that the lattice support structure is in the unfolded state. The connection braces 50 have a straight extent in this state.

The connection braces 50 and/or the groups of connection braces 50 are arranged spaced apart from one another in the longitudinal direction. They can be folded together via at least one joint such that the parts of the connection braces substantially extend in the longitudinal direction of the lattice support structure in the folded-together state.

As can further be seen from FIG. 1, connection elements 52 are provided which each connect two connection braces 50 together which are adjacent in the longitudinal direction.

Locking means can be provided which lock the connection braces 50 in the position shown and in this fashion prevent the lattice support structure from collapsing in an unwanted manner. Furthermore, connection elements can be provided which prevent the pivot levers 40 from being able to be pivoted inwardly, which means, in other words, that the lattice bars 20, 30 maintain the spacing of the connecting lattice bars 10 extending in the longitudinal direction. It is also conceivable to carry out the locking in that the connecting lattice bars 20, 30 can be locked at their ends at which they do not have a pivot lever 40. A locking is finally also conceivable in the intersection point of the lattice bars 20, 30. The use of clamping pieces or of bolts or the like is possible which prevent the positions of the lattice bars 20, 30 from varying with respect to one another.

FIG. 2 shows, as stated above, the arrangement in accordance with FIG. 1 in a folded-together position; FIG. 3 again shows different representations of the lattice support structure in accordance with FIG. 1 and in accordance with FIG. 2. It becomes clear from FIGS. 3*a*, 3*b* and 3*c* that the connecting lattice bars 20, located at the same level and on a side of the lattice support structure extend cross-wise.

Figure 3A:
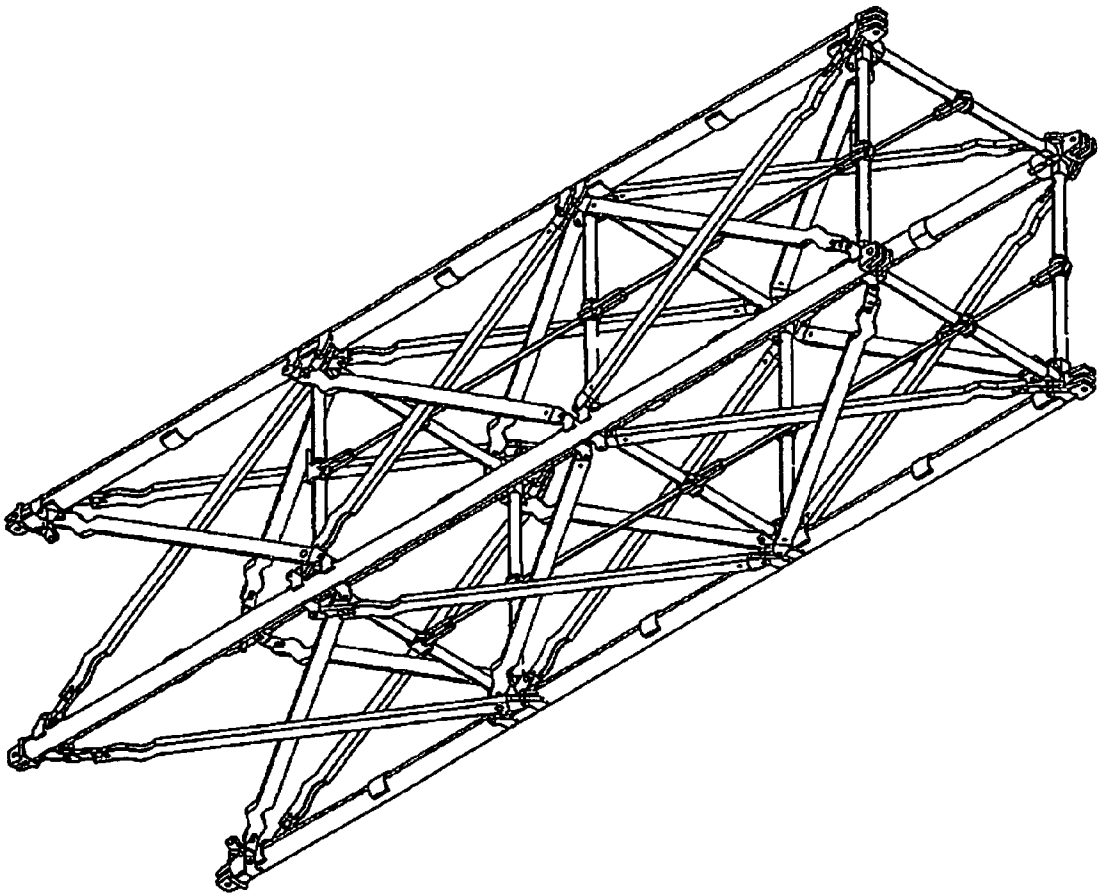
Figure 3B:
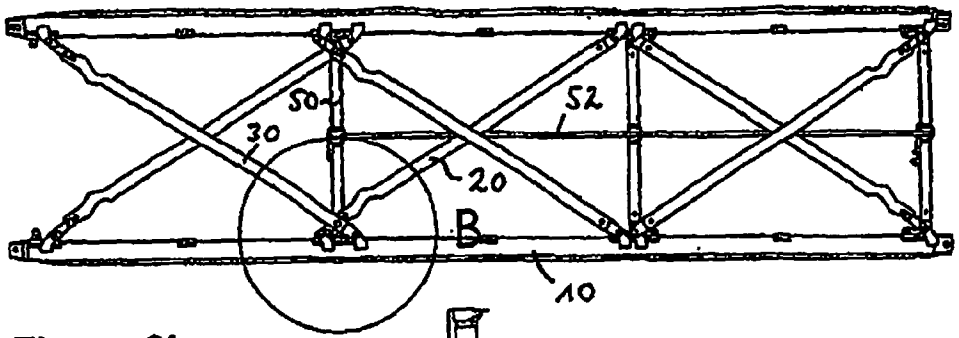
Figure 3D:
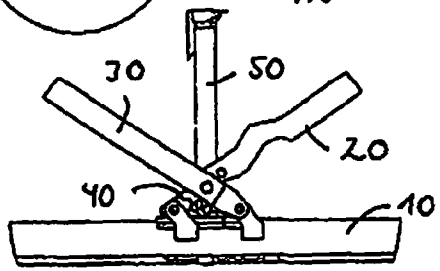
Figure 3C:
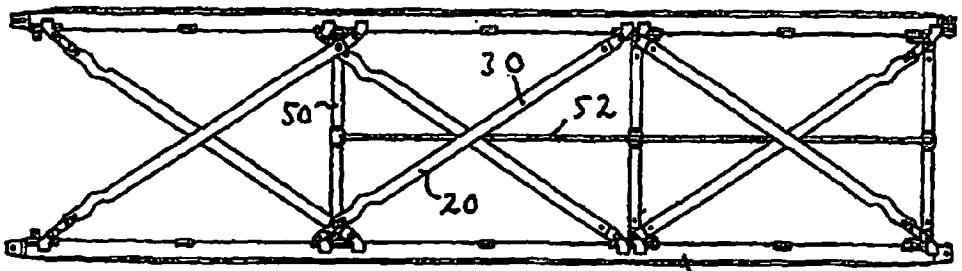
Figure 3E:
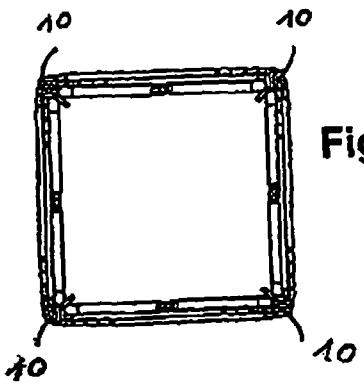

It becomes clear from FIG. 3*e* that the lattice support structure forms a square design in cross-section or in a plan view whose corners are formed by the lattice bars 10 extending in the longitudinal direction.

FIG. 3*d* shows the detail B in accordance with FIG. 3*b*. It again becomes clear from this Figure that the lattice bars are made with a pivot lever in one of their end regions, said pivot lever being pivotably connected to the adjacent region of the lattice bar and to the lattice bar 10 extending in the longitudinal direction. In contrast, the adjacently pivotably connected lattice bar 30 is not made with a pivot lever in the end region shown here. The pivot connection of the lattice bars 20, 30 to the lattice bar 10 takes place approximately or precisely at the level at which the connection element 50 is also arranged.

FIG. 4 shows the arrangement of a lattice support structure in accordance with the invention in a further embodiment. This substantially corresponds to the embodiment of 1; however, with the difference that some of the connecting lattice bars 20, 30 are not connected directly to the lattice bars 10 extending in the longitudinal direction, but only indirectly.

Reference is made in detail to FIG. 5 which shows the lattice support structure in accordance with FIG. 4 in different perspective and detailed representations.

Figure 5A:
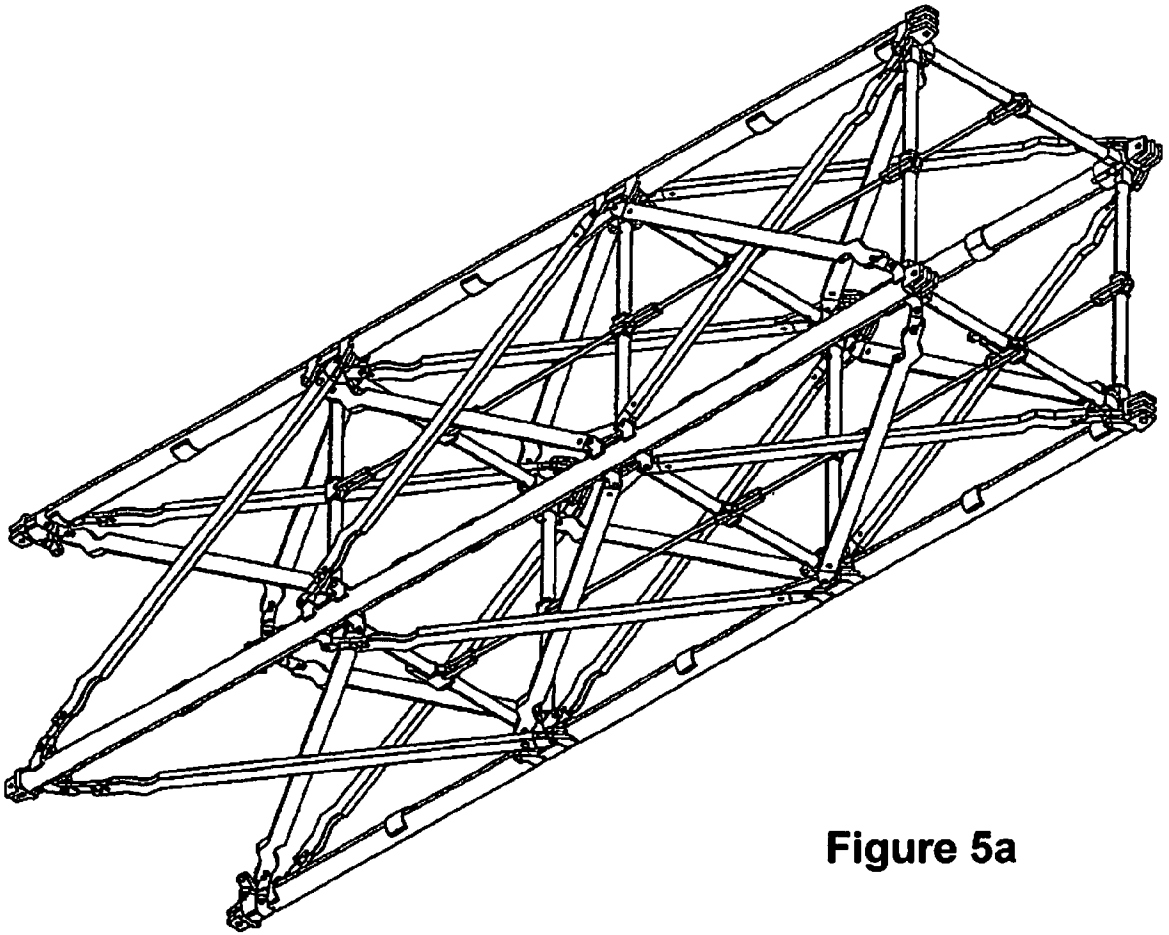
Figure 5B:
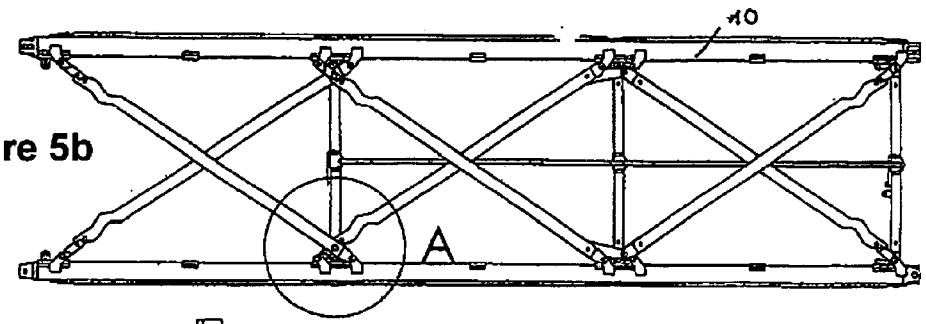
Figure 5D:
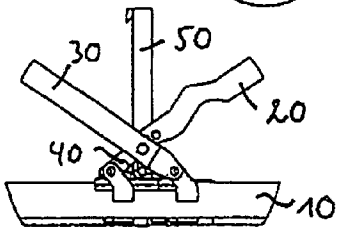
Figure 5E:
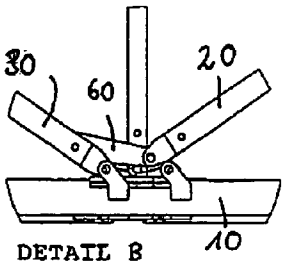
Figure 5C:
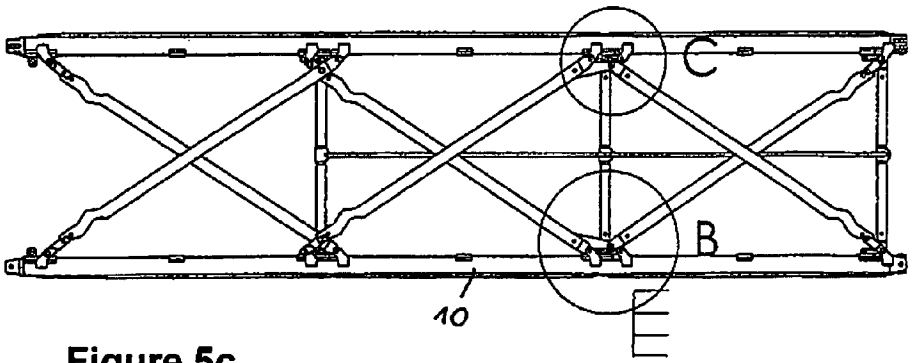
Figure 5F:
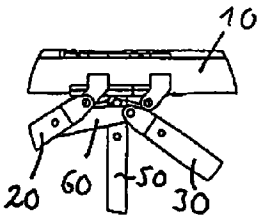
Figure 5G:
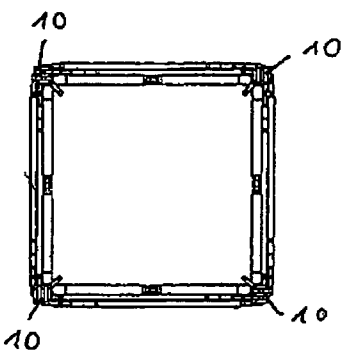

It can be seen from FIGS. 5*a*, 5*b*, 5*c* that the basic structure of the lattice support structure consists of four lattice bars 10 extending in the longitudinal direction and at which lattice bars 20, 30 connecting them are arranged directly or indirectly. As can be seen from FIG. 5*g*, it also applies to this lattice support structure that it is designed as a rectangle in cross-section.

The arrangement of the lattice bars in accordance with detail A in FIG. 5*d* corresponds to that already explained with respect to FIGS. 1 to 3. In this case, the end regions of the connecting lattice bars 20, 30 are directly pivotably connected to the lattice bar 10 extending in the longitudinal direction, with one of the lattice bars 20 having a pivot lever 40.

In contrast, it results from the detailed representation B and C that some of the connecting lattice bars 20, 30 are not directly connected to the lattice bars 10 of the lattice support structure extending in the longitudinal direction, but only indirectly. As can be seen from the detailed representation B in accordance with FIG. 5*e*, the lattice bar 20 is pivotably connected to the lattice bar 30 via a lever 60. The lattice bar 20 is, however, not directly pivotably connected to the lattice bar 10 extending in the longitudinal direction. The same applies accordingly to the detailed representation C in accordance with FIG. 5*f*. Here, only the lattice bar 20, but not the lattice bar 30, is directly pivotably connected to the lattice bar 10. Said lattice bar is—as stated above—pivotably connected via a connection lever 60 to the other of the lattice bars 20. In deviation from the embodiment in accordance with FIGS. 1 to 3, some of the lattice bars 20, 30 in accordance with FIGS. 4, 5 do not extend cross-wise in the region of their connection point to the lattice bar 10.

The invention claimed is:

1. A lattice support structure having lattice bars in connection with one another, wherein the lattice support structure comprises space apart longitudinal lattice bars and extending in the longitudinal direction of the lattice support structure as well as connecting lattice bars directly or indirectly connecting the longitudinal lattice bars, wherein the connecting lattice bars are connected to the lattice bars extending in the longitudinal direction such that the spacing of the lattice bars extending in the longitudinal direction of the lattice support structure can be reduced on the folding in of the lattice support structure and can be enlarged on the unfolding of the lattice support structure, wherein one, several or all of the connecting lattice bars are not displaceably arranged on the lattice bars extending in the longitudinal direction, but are rather pivotably arranged at the lattice bars extending in the longitudinal direction or are pivotably arranged at further connecting lattice bars which are in turn pivotably arranged at the lattice bars extending in the longitudinal direction, wherein the connecting lattice bars have at least a first end including a pivot lever which is pivotably connected to a lattice bar extending in the longitudinal direction of the lattice support structure and a second end connected to another lattice bar.

2. A lattice support structure in accordance with claim 1, wherein at least one of the connecting lattice bars have a first length when the lattice support structure is unfolded and a second length when the lattice support structure is folded in, with the first length being larger than the second length.

3. A lattice support structure in accordance with claim 1, wherein the connecting lattice bars are provided with said pivot lever only in one or in both of the ends of the connecting lattice bars.

4. A lattice support structure in accordance with claim 1, wherein the connecting lattice bars have a mount in the end region in which the pivot lever is arranged, with the pivot lever being able to be received in said mount at least sectionally.

5. A lattice support structure in accordance with claim 4, wherein the mount is a groove-shaped mount.

6. A lattice support structure in accordance with claim 1, wherein the connecting lattice bars are disposed in the outer surface or outer surfaces of the lattice support structure.

7. A lattice support structure in accordance with claim 1, wherein the lattice bars extending in the longitudinal direction of the lattice support structure form the outer edges of the lattice support structure.

8. A lattice support structure in accordance with claim 1, wherein the lattice support structure has a structure of lattice bars extending in the longitudinal direction which repeats in the longitudinal direction as well as connecting lattice bars.

9. A lattice support structure in accordance with claim 1, further comprising connection braces which extend perpendicular to the longitudinal direction of the lattice support structure in the unfolded state of the lattice support structure from one to another of the lattice bars extending in the longitudinal direction of the lattice support structure.

10. A lattice support structure in accordance with claim 9, wherein the connection braces have at least one joint by means of which they can be adjusted between an inwardly folded state and an outwardly folded state.

11. A lattice support structure in accordance with claim 10, wherein connection braces spaced apart in the longitudinal direction of the lattice support structure are connected to one another.

12. A lattice support structure in accordance with claim 1, further comprising a locking device for locking and fixing the connection braces and the connecting lattice bars in at least one position.

13. A lattice support structure in accordance with claim 1, wherein the lattice support structure has pivotably arranged lattice bars, wherein a pivotable connection is made between parts of the pivotably arranged lattice bars such that one of the parts pivotably connected to one another has a projection; and in that the other one of the pivotably connected parts has a groove which is bounded on three sides by walls and in which the projection of the other part is pivotably received.

14. A lattice support structure in accordance with claim 13, wherein the lattice bars have the projection at one end region of the lattice bars and the groove at a second end region; or the lattice bars have grooves or projections at the two end regions.

15. A lattice support structure in accordance with claim 1, further comprising a locking device for locking and fixing the connection braces or the connecting lattice bars in at least one position.

16. A lattice support structure having lattice bars in connection with one another, wherein the lattice support structure comprises space apart longitudinal lattice bars and extending in longitudinal direction of the lattice support structure as well as connecting lattice bars directly or indirectly connecting the longitudinal lattice bars, wherein the connecting lattice bars are connected to the lattice bars extending in the longitudinal direction such that the spacing of the lattice bars extending in the longitudinal direction of the lattice support structure can be reduced on the folding in of the lattice support structure and can be enlarged on the unfolding of the lattice support structure, wherein one, several or all of the connecting lattice bars are pivotably arranged at a fixed position at the lattice bars extending in the longitudinal direction or at a fixed position of further connecting lattice bars which are in turn pivotably arranged at a fixed position at the lattice bars extending in the longitudinal direction, wherein the connecting lattice bars have at least a first end including a pivot lever which is pivotably connected to a lattice bar extending in the longitudinal direction of the lattice support structure and a second end connected to another lattice bar.

17. A lattice support structure in accordance with claim 16, wherein at least one of the connecting lattice bars have a first length when the lattice support structure is unfolded and a second length when the lattice support structure is folded in, with the first length being larger than the second length.

18. A lattice support structure in accordance with claim 16, wherein the connecting lattice bars are provided with a pivot lever only in one or in both of the ends.

19. A lattice support structure in accordance with claim 16, wherein the connecting lattice bars have a mount in the end region in which the pivot lever is arranged, with the pivot lever being able to be received in said mount at least sectionally.

20. A lattice support structure in accordance with claim 19, wherein the mount is a groove-shaped mount.

21. A lattice support structure in accordance with claim 16, wherein the connecting lattice bars are disposed in the outer surface or outer surfaces of the lattice support structure.

22. A lattice support structure in accordance claim 16, wherein the lattice bars extending in the longitudinal direction of the lattice support structure form the outer edges of the lattice support structure.

23. A lattice support structure in accordance with claim 16, wherein the lattice support structure has a structure of lattice bars extending in the longitudinal direction which repeats in the longitudinal direction as well as connecting lattice bars.

24. A lattice support structure in accordance with claim 16, further comprising connection braces which extend perpendicular to the longitudinal direction of the lattice support structure in the unfolded state of the lattice support structure from one to another of the lattice bars extending in the longitudinal direction of the lattice support structure.

25. A lattice support structure in accordance with claim 24, wherein the connection braces have at least one joint by means of which they can be adjusted between an inwardly folded state and an outwardly folded state.

26. A lattice support structure in accordance with claim 25, wherein connection braces spaced apart in the longitudinal direction of the lattice support structure are connected to one another.

27. A lattice support structure in accordance with claim 16, further comprising a locking device for locking and fixing the connection braces and the connecting lattice bars in at least one position.

28. A lattice support structure in accordance with claim 16, wherein the lattice support structure has pivotably arranged lattice bars, wherein a pivotable connection is made between parts of the pivotably arranged lattice bars such that one of the parts pivotably connected to one another has a projection; and in that the other one of the pivotably connected parts has a groove which is bounded on three sides by walls and in which the projection of the other part is pivotably received.

29. A lattice support structure in accordance with claim 28, wherein the lattice bars have the projection at one end region and the groove at a second end region; or in that the lattice bars have grooves or projections at the two end regions.

30. A lattice support structure in accordance with claim 16, further comprising a locking device for locking and fixing the connection braces or the connecting lattice bars in at least one position.

* * * * *